United States Patent [19]

Neely et al.

[11] Patent Number: 4,949,892

[45] Date of Patent: Aug. 21, 1990

[54] METHOD AND APPARATUS FOR MAKING FLEXIBLE SECTIONS OF FENCE

[76] Inventors: John C. Neely, 152 Muriel Blvd., West St. Paul, Minn. 55118; John M. Czech, Jr., 529 Peterson La., Chippewa Falls, Wis. 54729

[21] Appl. No.: 421,533

[22] Filed: Oct. 13, 1989

[51] Int. Cl.[5] ..... B27F 7/00

[52] U.S. Cl. ..... 227/44; 227/45; 227/76; 227/100; 29/564.8; 221/253; 144/245 C; 144/353

[58] Field of Search ..... 227/44, 45, 48, 50, 227/100, 76; 29/411, 429, 432, 809, 33 K, 564.8; 144/245 C, 245 D, 353; 221/253

[56] References Cited

U.S. PATENT DOCUMENTS

| | | | |
|---|---|---|---|
| 517,586 | 4/1894 | Parks et al. | 227/76 |
| 1,248,414 | 11/1917 | Healy | 29/429 |
| 2,002,265 | 5/1935 | Kamper | 227/44 |
| 2,016,623 | 10/1935 | Brooks | 1/12 |
| 2,898,595 | 8/1959 | Newhouse . | |
| 3,763,547 | 10/1973 | Blakeslee | 29/430 |
| 3,774,486 | 11/1973 | Johnsson | 83/277 |
| 3,945,549 | 3/1976 | Colson | 227/45 |
| 4,334,346 | 6/1982 | Jensen | 29/429 |
| 4,467,951 | 8/1984 | Pagano | 227/48 |
| 4,478,361 | 10/1984 | McElhannon | 227/45 |
| 4,708,276 | 11/1987 | Knoth et al. | 227/100 |

FOREIGN PATENT DOCUMENTS

| | | | |
|---|---|---|---|
| 510568 | 3/1955 | Canada | 227/45 |
| 580862 | 8/1959 | Canada | 227/45 |

*Primary Examiner*—Hien H. Phan
*Assistant Examiner*—John M. Husar
*Attorney, Agent, or Firm*—Palmatier & Sjoquist

[57] ABSTRACT

An apparatus and process for making flexible sections of fence having an endless moving belt moving the individual fence pickets therethrough, and hopper stations individually dispensing the pickets onto the moving belt for transport to a fastening station where the fixedly spaced pickets are attached to continuous stringers and transported therefrom where the fence section thus formed is cut in the selected lengths.

14 Claims, 6 Drawing Sheets

METHOD AND APPARATUS FOR MAKING FLEXIBLE SECTIONS OF FENCE

BACKGROUND OF THE INVENTION

The present invention relates generally to the making of elongate sections of fence and the like, and more specifically, to an apparatus and method for making elongate flexible sections of a movable decorative fence which may be placed wherever desirable for landscaping purposes.

At the present time, it has become popular to landscape an area using a small fence consisting of multiple boards or pickets to delineate the boundaries of areas of landscaping. The individual pickets used are typically approximately six inches in length by three inches in width, having a thickness of nominally ¾ of an inch, and have a substantially rectangular shape with the corners at the top end cut off and are commonly called dog-eared pickets.

While the landscaper may purchase raw wood and make his own pickets, this would involve hand cutting each picket, which would be quite time consuming, and, furthermore, the landscaper would be purchasing the wood in such small quantities that the cost of wood would become excessive. Additionally, if each individual picket was placed to form the desired fence, each picket would need to be placed into the ground at a specific depth and at a specific spacing to provide the aesthetically pleasing view of a regularly spaced fence.

This placement of the individual pickets would also be quite time consuming, and owing to the variations of the soil where the pickets are placed. For example, soft soil would be ineffective to retain the picket in the chosen upright position.

In response to the market demands, several vendors have begun to produce precut lengths of decorative picket fence for sale. A typical precut length of picket consists of the multiple pickets constructed of wood, plastic or other suitable material, disposed along the length of one or more rigid stringers. While the use of such lengths of decorative fencing allows the landscaper to purchase the precut lengths which are readily installed in the selected locations, the use of the rigid stringers limits the use of these precut lengths to straight runs of fencing, and requires the stringers to be cut or broken to produce a corner in the fence.

We have found that it is not necessary to use a rigid stringer to provide the necessary rigidity along the length of a run of decorative fence, but that sufficient rigidity can be provided using a flexible stringer. The use of a flexible stringer allows the fence to be coiled for storage and shipment, thereby enhancing the ease of handling while allowing the fence to be economically packed.

Previously, when such flexible stringer fence was made, it was made manually by spacing the pickets along a work table and manually fastening the wire stringer transversely therealong to form the fence lengths. While this method does produce the fence lengths as desired, it is a very labor intensive method and therefore an expensive method of producing the fence, which negates most of the cost savings in materials that would have accrued owing to the scale of commercial manufacturers. Additionally, manually making fence is a very repetitive, boring, and low skilled work. It is difficult, therefore, for the workers to perform the repetitive task and maintain a sufficient quality standard.

The prior art discloses several devices and methods for attaching a plurality of transverse members along longitudinal stringers. Most of these devices are drawn toward the attachment of transverse members to rigid stringers.

Such devices are exemplified in U.S. Pat. No. 3,763,547, issued Oct. 9, 1973, to Blakeslee for an automatic fastening machine. The Blakeslee apparatus provides a plurality of longitudinal magazines holding a supply of stringers and a transverse magazine holding a supply of transverse members, and a multiple chain drive mechanism for synchronizing the movement of the longitudinal stringers and the transverse members from the magazines to fastening stations where the collection of stringers and transverse members is stopped while the fasteners are inserted. This process is then repeated a fixed number of times, until the longitudinal stringers receive their last transverse member, thus completing the construction of one frame.

U.S. Pat. No. 3,945,549 issued March 23, 1976, to Colson, discloses a somewhat complex apparatus for producing pallets and the like by feeding the transverse members onto the moving longitudinal stringers which are advanced to a nailing station where the movement is stopped, and at least one nail is inserted therein at the juncture of each stringer and transverse member.

U.S. Pat. No. 4,467,951 issued Aug. 28, 1984, to Pagano for Apparatus for Nailing Pickets on Stringers discloses another variant of an apparatus for fastening transverse members to longitudinal stringers. Similarly, Pagano places transverse members on advancing rigid stringers at a predetermined spacing and advances this array to a nailing station. Pagano advances the prior art by movably mounting his nailing guns so that the nailing point of the gun traces an elliptical path allowing the nailing gun to be fired upon contact with the transverse member while moving synchronously therewith, simplifying the timing requirements of the apparatus.

Another variation is disclosed in U.S. Pat. No. 2,016,623, issued to Brooks on Oct. 8, 1935. Brooks discloses a machine for attaching for a multiplicity of transverse members along the length of metal strips while forming the fasteners integral with the metal strips. The Brooks apparatus is a heavy duty unitary device which cuts and forms fastener ears along the length of metal strip and thereafter presses these fastening ears into the plurality of transverse members synchronously carried along a conveyor system. The Brooks machine requires synchronizing the movement of the metal strip to the movement of the plurality of transverse members, and, once set up, appears to be limited to a fixed spacing of transverse members having a fixed width along the length of the metal strip stringer.

SUMMARY OF THE INVENTION

The invention involves an apparatus for feeding individual pickets from a hopper for placement along an elongate flexible stringer and attachment thereto and thence cutting the lengths of fence formed into convenient lengths for packaging and shipment.

The invention disclosed herein is an apparatus for continuous-flow making of lengths of decorative fence. The invention consists of a moving belt endless conveyor for receiving the individual pickets, and transporting the pickets through the apparatus. The pickets are first placed in a storage hopper, located overlying the moving conveyor belt. From the storage hopper, the pickets are individually dispensed in a spaced relationship onto the moving conveyor and carried therefrom to a fastening station. Concurrent with the movement of the pickets, the flexible stringer is dispensed and located along the pickets for attachment thereto. As the pickets pass through the fastening station, their presence is sensed, and used to trigger the insertion of a fastener attaching the flexible stringer to each picket.

As the pickets pass to the bottom of the hopper, the bottom two pickets are segregated from the remaining stack, using two retainers. The one separator further segregates the bottom-most picket, allowing it to fall onto the conveyor belt and be urged forward thereby.

From the fastening station, the fence sections are advanced by the conveyor belt through a guillotine station which is periodically triggered responsive to the movement of the conveyor belt, cutting the fence sections into predetermined lengths. The fence sections are now completed and may be rolled for storage and packaging and shipment.

It is an object of the present invention to provide an apparatus for quickly and accurately producing lengths of landscaping fence.

It is another object of the invention to provide an apparatus wherein the attachment of the stringers to the pickets and the cutting the fence into lengths is synchronous and responsive to movement of the conveyor belt therethrough.

It is another object of the invention to provide an apparatus for making landscaping fence which minimizes the amount of manual labor required.

It is a further object of the invention to provide an apparatus that can reliably feed a single picket onto a moving conveyor belt.

The foregoing and other objects of the invention will become apparent upon reading the following specification, with reference to appended claims and the drawings.

BRIEF DESCRIPTION OF THE DRAWINGS

FIG. 2 is an overhead view of the invention.

FIG. 3 is an enlarged perspective view of the picket feeding hopper portion of the invention.

DESCRIPTION OF THE PREFERRED EMBODIMENT

Figure 1:
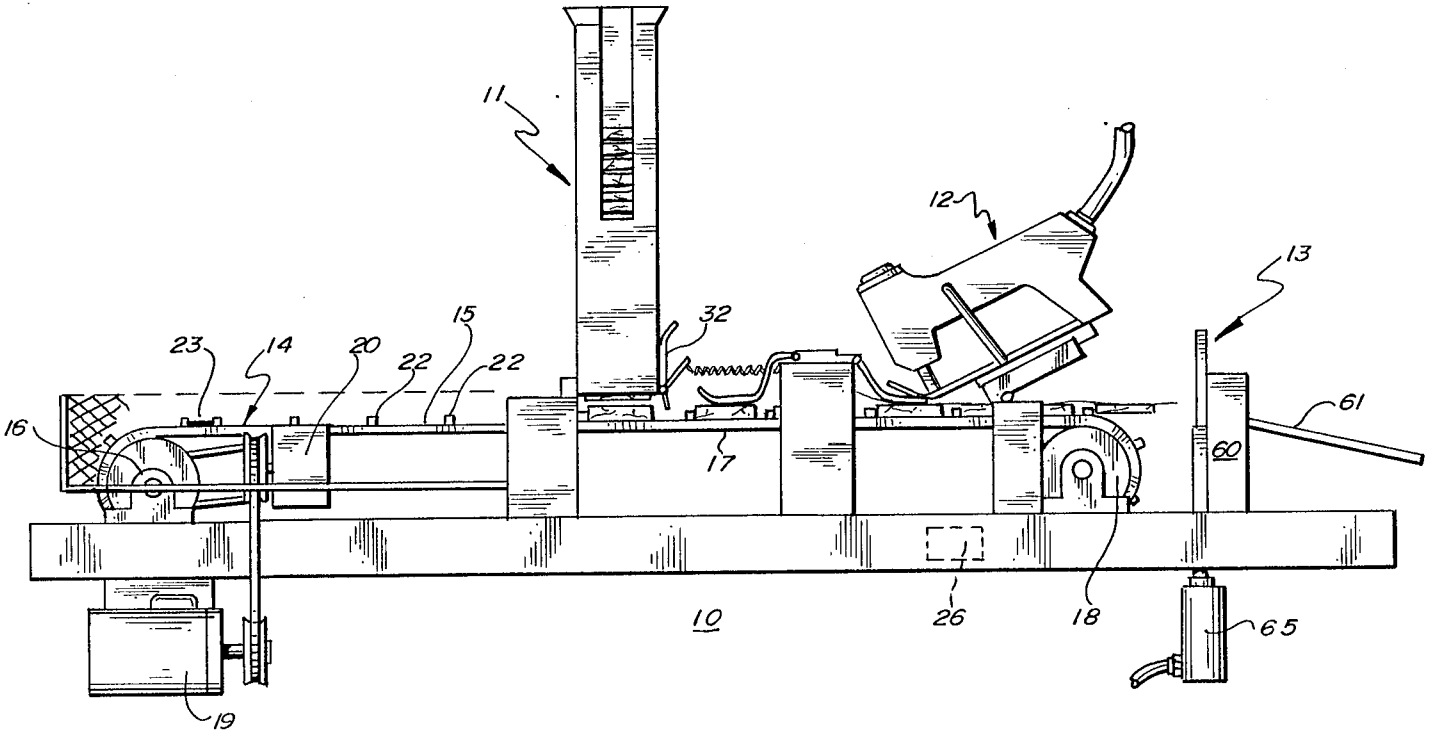
FIG. 1 is an overall side view of the invention in operation.

Referring first to FIG. 1, where the invention, generally 10, consisting of the hopper station 11, the fastening station 12 and the guillotine station 13 disposed along the length of an endless belt conveyor.

The belt conveyor 14 consists of an endless belt 15 composed of a rubber or elastomeric material of conventional design running from the tail roller 16 over a stabilizing work table 17 past the hopper station 11 and the fastening station 12 to the head roller 18, and returning therefrom to the tail roller 16. The belt is driven by any conventional means, and is preferably driven by an electric motor 19 through a suitable reduction gearing box 20 to drive the tail roller 16, thereby urging the belt 15 into motion. Although the belt 15 may be driven through the head roller 18, it is preferred that the belt 15 be driven through the tail roller 16 to provide a clutching effect should the belt 15 become jammed in operation. Thus, the tail roller drive prophylactically abrogates the need for a separate slip clutch between the electric motor 19 and the belt 15.

A plurality of drive bars 22 are attached to the outer surface of the belt 15 perpendicular to the direction of belt movement and extending slightly less than the full width of the belt 15. The drive bars 22 may be formed of any suitable rigid non-wearing material and thus far have been made of iron. The height of the drive bars 22, as measured from the surface of the belt 15 may be of any height sufficient to carry the pickets 21 along the belt 15 without interfering with the operation of the hopper station 11. It is preferred, however, that the height of the drive bars 22 be slightly less than the height of each picket 21. The width of each drive bar 22 is used to define the spacing between the adjacent pickets 21 and may be varied, depending on the size of the individual picket 21 in use and other aesthetic considerations.

The spacing between the adjacent drive bars 22 is determined based on the width of the pickets 21 being used. Thus, the spacing along the belt 15 of the drive bars 22 will be slightly greater than the width of a picket 21. In practice, it is been found that, as the spacing between the drive bars 22 approaches the width of the picket 21, the pickets 21 will not reliably fall into the designated space, causing missing pickets 21 in the fence or jamming the operation of the machine 10. Additionally, as the spacing between the adjacent drive bars 12 is increased in excess of the width of the pickets 21, the placement of the pickets 21 along the drive belt 15 becomes unreliable and the fence thus produced will have unevenly spaced pickets 21. In practice, it has been found that the preferred spacing between adjacent drive bars 22 is such as to allow the insertion of one picket 21 and an additional space of approximately 1⅛ of an inch. Thus, the spacing between two adjacent drive bars 22 is dependent upon the width of the picket 21 being used. When pickets of a different width are selected, it is therefore advantageous to change not only the drive bars 22 but to replace the entire conveyor belt assembly 14 with one adapted for the particular picket width in use.

In addition to the drive bars 22 located along the belt 15, there is also an end bar 23 and a guillotine bar 24. The end bar 23 is effectively a drive bar 22 having a greater width to define the end of one section of fence. The end bar 23 may be formed of any suitable material having a suitable width. It is found to be preferred to form the end bar by using a pair of regular drive bars 22 to form a first and second end bar 23.1, 23.2.

While the two closely spaced bars 23.1 and 23.2 will function to define an end bar and operate reasonably well, there is some interference to hopper station 11 by the pickets 21 attempting to fit the too small a space between the respective end bars 23.1 and 23.2. It is therefore preferable to include a flexible spacer 25 between the two end bars 23.1 and 23.2 to prevent the ingress of a picket therebetween. The flexible spacer 25 may be made from any suitable material and is conveniently constructed of a short length of roller chain having a sufficient height to prevent a picket 21 from entering the space between the end bars 23.1 and 23.2.

The guillotine bar 24 precedes the end bar 23 and is formed identical to any one of the drive bars 22, excepting having a greater length so as the guillotine bar 24 extends beyond the edge of the belt 15, so as its passage actuates the guillotine section 13 using the guillotine actuator 26 located adjacent the bottom or return portion of the belt 15.

The hopper station 11 consists of a "C" shaped hopper 30 extending vertically above the belt 15, having a length and width to fit loosely about the individual pickets 21. The hopper 30 is a sufficient height so as to store a large number of pickets 21 when stacked one upon another. Thus, multiple pickets 21 may be placed within hopper 30 and the pickets 21 are urged downwardly toward the belt 15 through gravitational force.

The "C" shape of the hopper 30 provides an opening slot 31 where the operator can visually determine the amount of pickets 21 remaining in the hopper 30, and add pickets 21 when necessary. At the lower edge of the hopper 30, and adjacent the belt 15, the first picket segregating stop 32 is attached overlying and extending past the end of the hopper and proximate the moving drive bars 22. The first picket stop 32 consists of a settable plate 33 attached to the hopper 30 in a manner allowing upward or downward movement of the settable plate 33. The settable plate 33 may be attached to the hopper conveniently using attachment bolts 34 affixed to the hopper 30, passing through elongate adjustment slots 35 formed in the settable plate 33.

The second part of the first picket stop 32 is a door 35 which is hingedly attached along the lower edge of the settable plate 34 using a hinge 36 extending the length thereof. The door 35 is biased to a vertical position using the spring 37 operating through the door arm 38.

A second picket separator 40 fits abutting the settable plate 33 and within the open slot 31 of the hopper 30 and is mounted attached to the settable plate 33 on the second separator mount 41 affixed to the settable plate 33. The second separator 40 extends downwardly therefrom and angularly inwardly into the hopper 30, having its terminal end 42 spaced approximately one and one-half picket heights above the belt 15.

After placement of the one picket 21 between the respective drive bars 22, moving belt 15 carries the picket past the first hold down 43, which urges the picket 21 downwardly and in an abutting relationship with the belt 15. Thereafter, the one picket 21 is carried to the fastening station 12.

Additionally delivered to the fastening station 12 is the flexible stringer. The flexible stringer may be of any suitable material providing the requisite combination of rigidity and flexibility between the adjacent pickets 21. It has been found in some instances that an elongate sheet of a plastic material such as polyethylene having a suitable thickness provides these necessary characteristics, and thus, may be inserted therein.

In most applications, however, it is preferred to use two elongate wires to form the flexible stringer between the adjacent pickets 21. The stringer wire 44 may be any suitable material and is preferably 19 gauge soft iron wire. FIG. 2 shows the wire spools 45 being located in an offset manner past the tail roller 16 of the apparatus 10. It is understood, however, that the location of the wire spools 45 is unimportant to the invention and they may be located in any convenient location, and are preferably located somewhere near the tail roller 16 so that the path of the stringer wire therefrom can be guided into a reasonably straight path to the fastening station 12. This location allows the passage of the stringer wire 44 through respective first wire guides 46 around the respective ends of the hopper 30 and thence to the fastening station 12.

Figure 5:
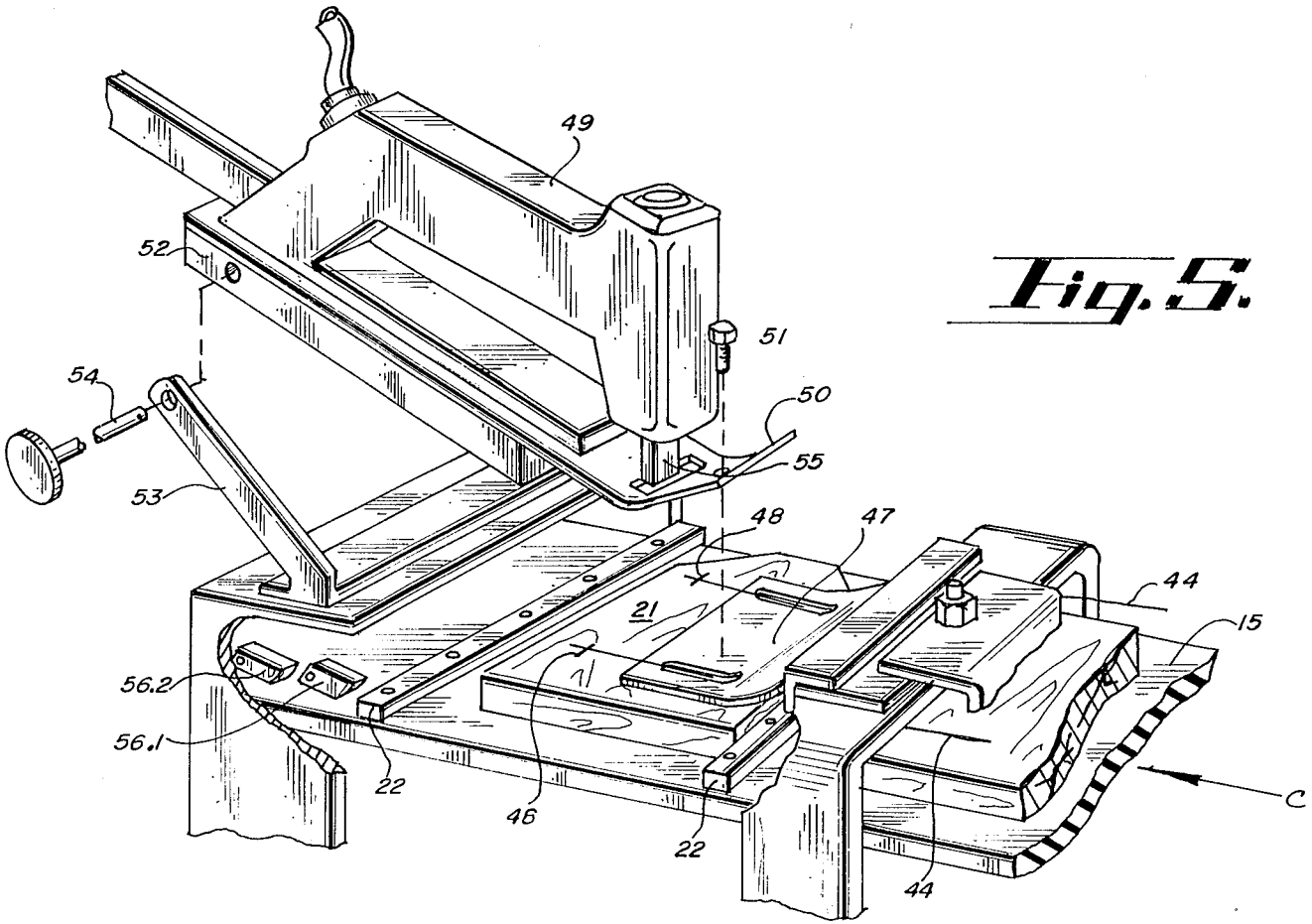
FIG. 5 is a partially exploded perspective view of the stapling station of the invention.
Figure 6:
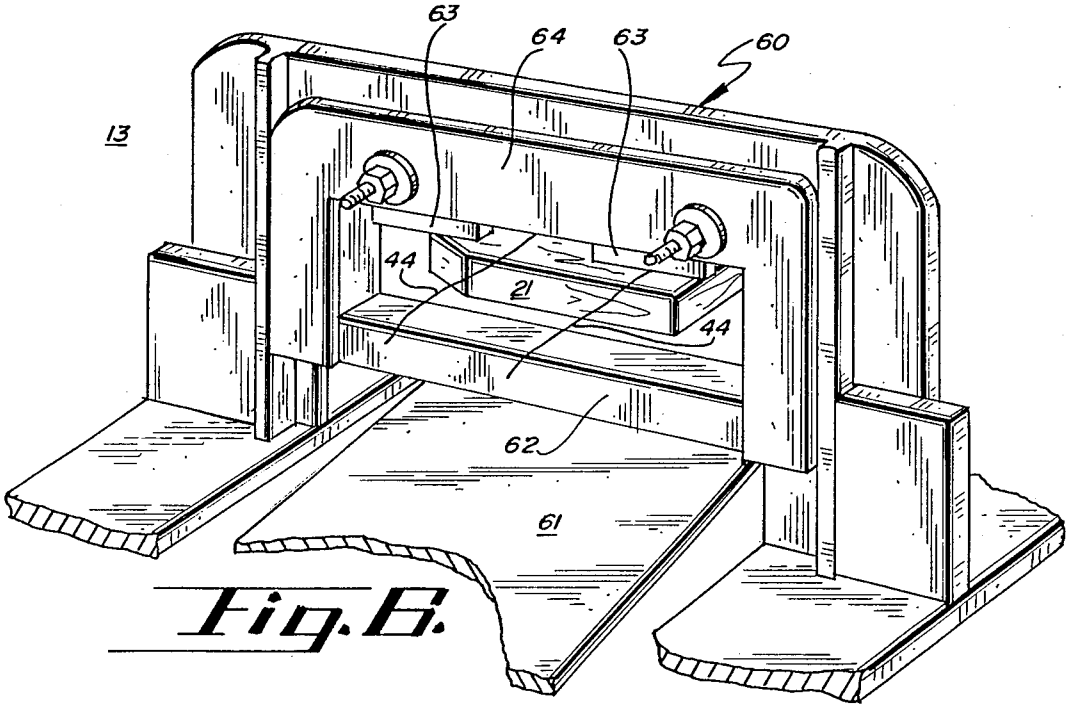

The fastening station 12, as more clearly shown in FIG. 5, has a second picket hold-down 47 for guiding the pickets 21 downwardly to abut the belt 15, where the stringer wire 44 is attached to each picket 21. While the stringer wire 44 may be attached to each picket 21 using any suitable fastener, it is preferable that staples 48 be used. The staples may be attached using any suitable stapling gun 49, and it is preferred to use a stapling gun 49 such as the Duofast Model BN 1832, which is an air operated stapling gun 49 operated in the open trigger mode. Such stapler guns are available from Duofast Corporation of Franklin Park, Illinois. The stapler 49 is mounted on stapler mount 50, such as Martin-Lewis magazine, also available through Duofast Corporation, which has adapted by addition of a height adjustment screw 51 passing therethrough.

The staples 48 used may be of any suitable size and are preferably quarter inch staples, having a length sufficient to attach the stringer wires 44 without passing entirely through the individual pickets 21. Suitable staples are available from Duofast, and numerous other vendors.

While only one stapler 49 is shown in FIG. 5, it is understood that it is preferred to use two staplers 49, as is shown in FIG. 2.

Each stapler 49 and its respective stapler mount 50 has a mounting bar 52 attached to its respective stapler mount 50. The mounting frame 53 is fixed to the apparatus 10 and extends over the belt 15. The mounting bar 52 is pivotally attached to mounting frame 53, using the removable pin 54, which places the stapler 49 over the belt 15 and the individual pickets 21. The height adjustment screw 51 of the stapler mount 50 extends downwardly therefrom, resting on the second hold down 47. The height adjustment screw 51 is adjustable and used to set the height of the stapler anvil 55 above the picket 21. It has been found necessary to include the height adjustment screw 51 since, owing to variations in the thickness of the pickets 21, the stapler anvil 55 must float above the surface of the picket.

When the anvil 55 is set at too low a height, it will drag upon the surface of the picket 21 and jam the apparatus 10. Conversely, when the anvil 55 is set at too great a height above the surface of the picket 21, the individual staples 48 will not be driven fully into the pickets 21, and will therefore not properly attach the stringer wire 44 thereto.

While it is not necessary, it is preferred to attach each stringer wire 44 to each picket 21 at two locations, using the staples 48. In order to locate the staples 48 properly with respect to each picket 21, the actuation of the stapler 49 must be coordinated with the position of the individual pickets 21. The actuation of each stapler 49 may be readily effected responsive to the passage of each picket 21 using a pair of actuator skis 56, locating riding along the upper surface of the belt 15, such that the position of a picket 21 thereby will urge each actuator ski 56 away from the belt 15, as indicated by arrow (A) in FIG. 5. Thus, as each picket 21 passes the first actuator ski 56.1, the ski 56.1 is urged upwardly away from the belt 15, triggering the stapler 49 to insert a staple 48 at the selected location. As the picket 21 advances, it next trips the second actuator ski 56.2 thereby again triggering the stapler 49 and causing the insertion of a second staple 48 in the picket 21.

The actuation mechanism whereby each ski 56 actuates each stapler 49 involves using micro switches to trigger relays controlling the flow of air to each stapler 49. Such actuating systems are well known in the art and may be readily constructed from commonly available micro switches and relays and are therefore not shown or described in detail.

The thus-constructed fence sections are then carried along with belt 15 past the head roller 18 and into the guillotine section 13. The guillotine section 13 consists of a guillotine frame 60 having a central opening through which the individual pickets 21 forming the fence section pass. After the fence section passes therethrough, the pickets 21 slide along the output table 61 where they are removed for packaging and shipment.

Figure 6:
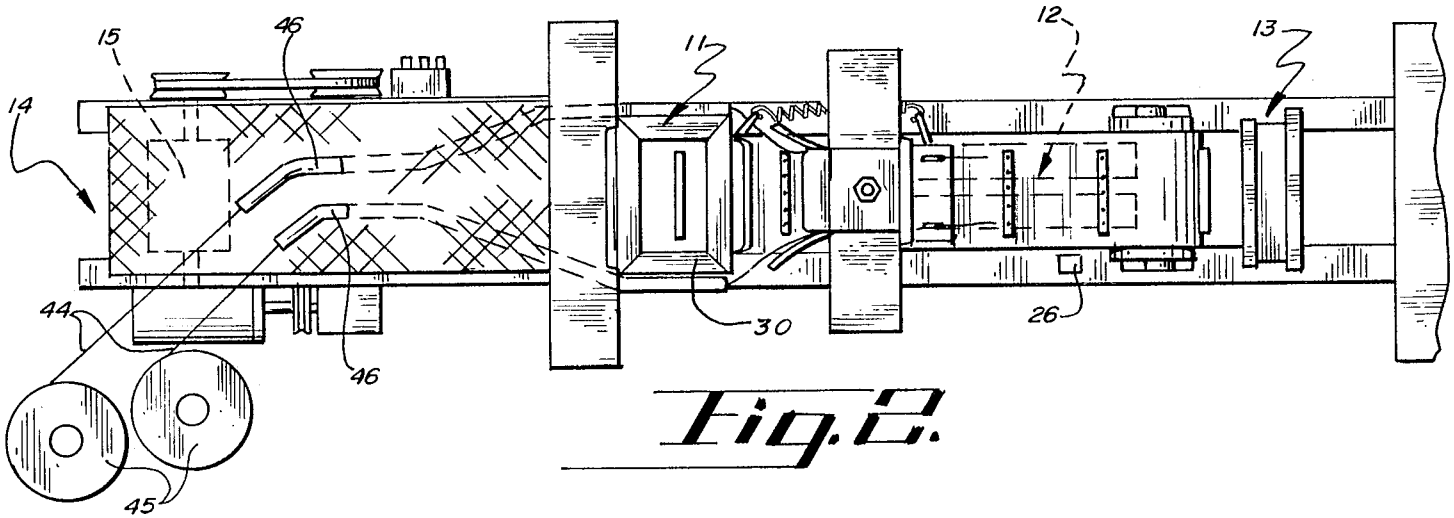
FIG. 6 is a perspective view of the guillotine station of the present invention.
Figure 7:
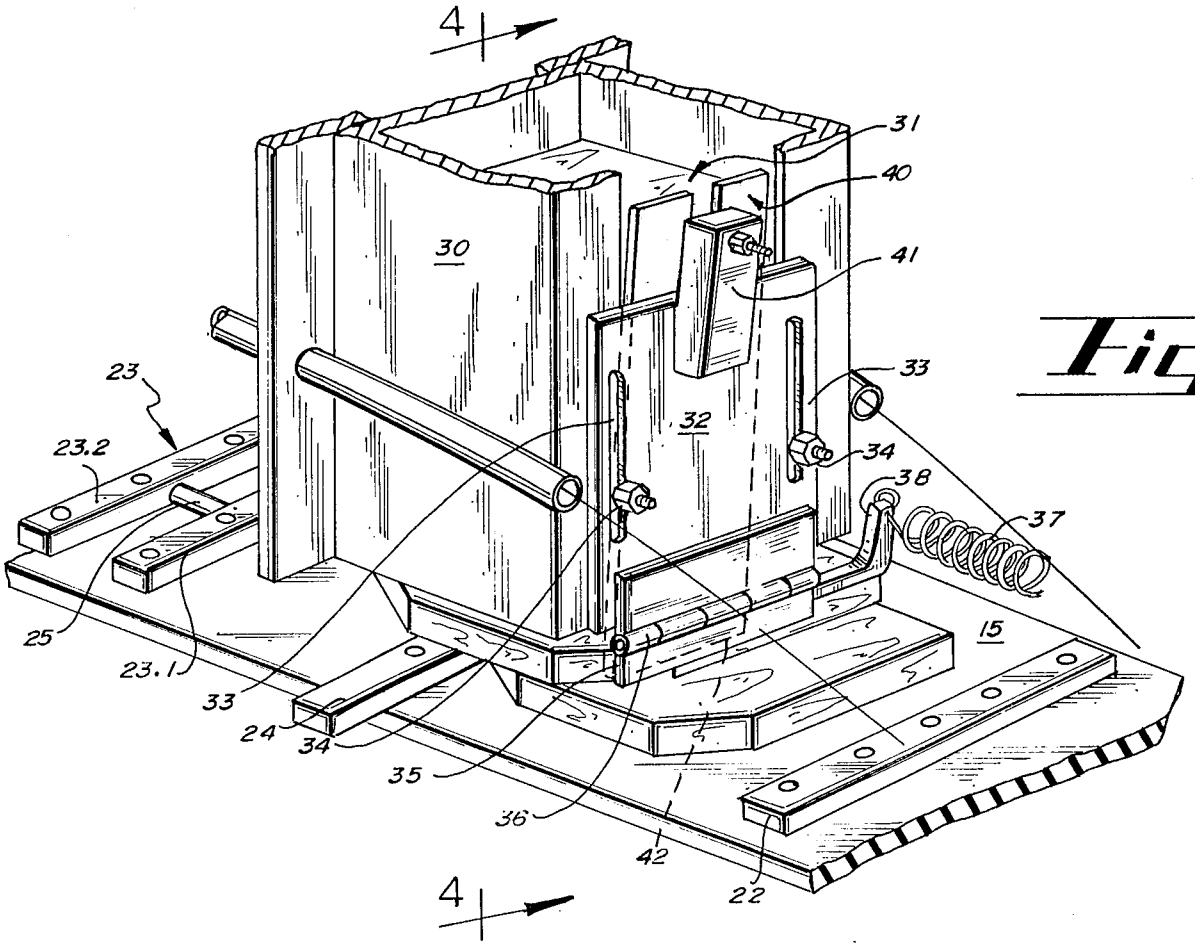
FIG. 7 is an overhead plan view of one picket of the type contemplated for use in the invention.

Guillotine frame 60 is a rigid frame containing an anvil 62 and movable cutter blades 63. The cutter blades 63 are attached to the cutter frame 64 which is held in its open position, as shown in FIG. 6, by spring tension using springs, not shown. When actuated, the cutter blades 63 descend to abut the anvil 62, thereby cutting the stringer wire 44 passing therebetween. The guillotine section 13 is actuated responsive to the guillotine bar 24, actuating the guillotine actuator 26, thereby causing the guillotine cylinder 65 to urge the cutter frame and the attached cutter blades 63 downwardly, so as the cutter blade 63 abuts the anvil 62.

The guillotine actuating mechanism 26 includes a micro switch actuated by the passage of the guillotine bar 24, triggering a relay, not shown, to actuate the guillotine cylinder 65. These uses of micro switches and relays are well known in the art, and use readily available micro switches and relays, and the conventional technology thereof, and will not be described in detail.

Thus, each passage of the guillotine bar 24 past the guillotine actuator 26 causes the movement of the guillotine cutter blades, cutting through the stringer wire 44, between the two adjacent pickets 21 formed over the end bar 23 located upon the belt 15, cutting free one section of the fence thus produced.

Should it be desired to produce sections of fence using pickets 21 having a different width, it is necessary thence to only make the adjustments to hopper 30 so as to accept the different width pickets 21 and replace the belt conveyor 14 with a different belt conveyor 14 adapted by having the appropriate spacing between its respective drive bars 22 to accept these pickets 21. The actuation of the staplers 49 will remain responsive to the passage of each picket 21 past each ski 56 and will therefore adjust automatically to pickets of varying widths.

In its operation, the operator fills the hopper 30 using a suitable number of pickets 21, that have been previously cut to size. The stringer wires 44 are then threaded through the first wire guide 46 around the hopper 30 and through the second wire guide 70. A suitable supply of air is then provided for operation of the staplers 49, and the guillotine cylinder 65. The drive motor 19 is then actuated, causing rotation of the tail roller 16 through the reduction gearing 20 and movement of the belt 15 of the belt conveyor 14.

Figure 4:
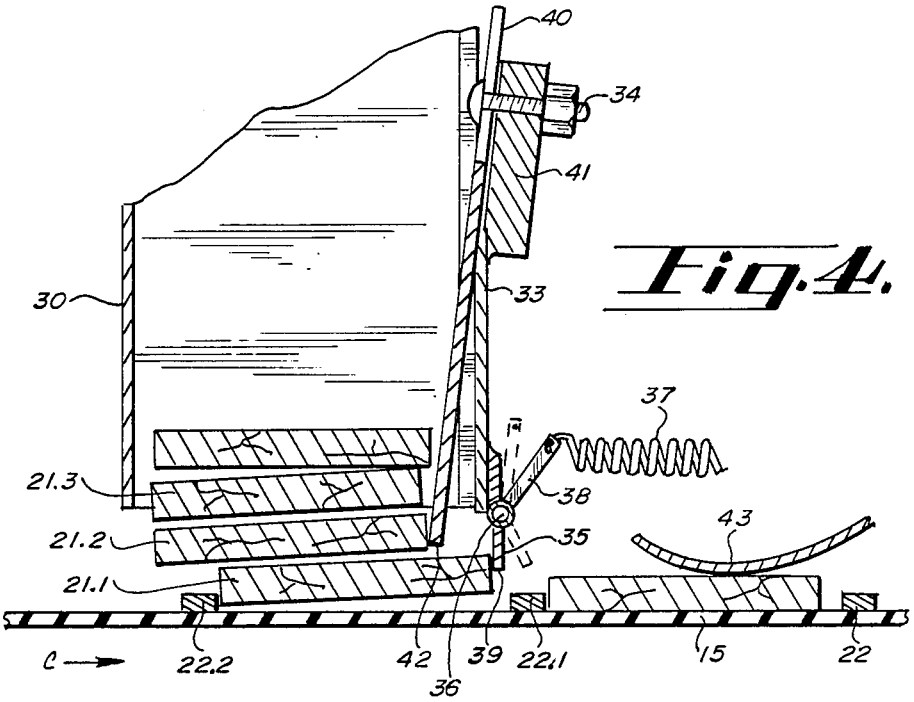
FIG. 4 is a cross-sectional view of the picket segregating mechanism taken approximately along 4—4 of FIG. 3.
Figure 7:
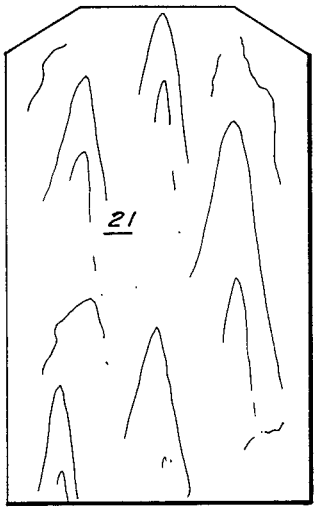

As the belt 15 moves beneath the hopper station 11, the pickets 21 are urged downwardly by gravity to abut the belt. However, the picket can only fall onto the belt between two adjacent drive bars 22. FIG. 4 illustrates the separation and dispensing of one picket onto the belt. For the purpose of explaining the operation of the hopper section 11, the pickets 21 are further identified with the bottom-most picket as 21.1, the second picket is 21.2, the third picket is 21.3, etc. It being understood that the references to the individual pickets is in relationship to the picket position within the hopper 30 stack, and that as one picket 21 is removed by conveyor 14, the pickets move down.

As the belt 15 with its attached drive bars 22 is moved responsive to the motor 19 in the direction shown by arrow (C) on FIG. 4, the bottom-most picket 21.1 first rests upon the upper surface of a drive bar, as indicated at 22.1. As the belt further moves forward, the friction between the drive bar 22.1 and the bottom-most picket 21.1 urges the picket in the direction of the belt, and against the second picket separator 40. As the leading drive bar 22.1 passes the first picket 21.1, the space between the leading drive bar 22.1 and the trailing drive bar 22.2 becomes available to accept the downward motion of the first picket 21.1 and the first picket drops past the terminal end 42 of the second picket separator 40 and into the space between the two drive bars.

The picket thence may be drawn forward by the belt toward the next, or fastening station, 12. In most instances, the bottom-most picket 21.1 will assume a position abutting the belt 15 surface and will therefore pass beneath the door 35 of the first picket separator 32 and on. However, in some instances the picket may not completely fall during the time allowed and the leading edge of the picket 21.1 will be slightly above the surface of the belt 15, which is shown in FIG. 4. Thence, the belt will draw the picket 21 forward, driven by the trailing drive bar 22.2 against the door 35 of the first picket separator 32, urging the door 35 to an open position in phantom. As the door 35 further opens, its bottom edge 39 will rise with relationship to the belt 15 owing to the arcuate movement of the door bottom edge 39, allowing additional space for the first picket 21.1 to pass thereunder. The movement of the door 35 will increase the tension upon the door spring 37 and thus, as the door bottom edge 39 opens to allow passage of the first picket 21.1 thereunder, the door spring 37 will be urging the door 35 toward a closed position and therefore pushing the first picket 21.1 downwardly while closing the door 35.

During this process, the second picket 21.2 is drawn in the same direction as the first picket 21.1 by friction therebetween and will abut against the second picket separator 40, thereby allowing the freer movement of the first picket 21.1, and further segregating the first picket 21.1 from the second picket 21.2 and segregating the second picket 21.2 from the remaining pickets 21 in the hopper 30. This effectively segregates the mass of the stack of pickets 21, 21.3 and upwardly therefrom from the two lower pickets 21.1 and 21.2, allowing the smooth dispensing of the bottom-most picket 21.1 onto the belt 15 without interference from the mass of the numerous pickets 21 stacked thereon.

As each picket 21 is carried along belt 15 from the hopper station 11, it passes first under the first hold down 43 which urges the picket downwardly against the belt 15 surface, preventing the upward movement of the picket 21 from warpage or other non-uniformity of the picket 21 or responsive to the picket 21's interaction with the bottom edge 39 of the door 35.

The pickets 21 thus arrayed are thus carried forward to the fastening station 12 where the wire stringer 44 is attached thereat using staples 48. The belt 15 carries the pickets 21 first under a second hold down 47 where the stringer wire 44 is fed through the second wire guide 70, aligning the stringer wire 44 with the stapler anvil 45, for attachment using the staple 48. The second hold down 47 is hingedly attached to a mount and rides upon the upper surface of each picket 21. Each stapler 49 is likewise pivotally attached through a mount pin 54, and partially overlies the second hold down 47. The height relationship of the stapler 49 and its anvil 55 is controlled by adjusting the height adjustment screw 51, and thus, the stapler 49 and its respective mount 50 ride upon the second hold down 47 and float a fixed distance above the surface of the picket 21. As the picket 21 is advanced, as indicated by the arrow (C), its leading edge first contacts the first ski 56.1 and displaces the ski 56.1 in an upward direction, as indicated by arrow (A). Responsive thereto, the staplers 49 are actuated, driving the respective anvils 55 in a downward direction and inserting staples 48, overlying the respective wire stringers 44 and attaching a stringer wire 44 to the picket 21.

As the belt 15 continues to advance the picket 21, it next contacts the second ski 56.2, which is similarly urged in an upwards direction away from the surface of the belt 15, as indicated by arrow (A), thereby again actuating the staplers 49, causing the placement of a second staple 48 and attaching the respective stringer wires 44 to the picket 21. The cycle as thus described is thence repeated, with the next picket.

As the pickets 21, now a fence section, have been fastened and are carried past the fastening station 12, they are carried thereafter along the length of the work table 17 and past the head roller 18, into the guillotine section 13, and finally to the output table 61.

The pickets normally pass through the opening in the guillotine frame 61 uninterrupted and uneffected, excepting when the end point of a fence section is periodically sensed. The end point of the fence section, which is the space between two adjacent pickets defined by the end bars 23, passes under the guillotine cutters 63, the end bar 23 is disposed to actuate the guillotine actuator 26, thereby causing the cutter blades 63 to descend to the anvil 62, thereby cutting the stringer wires 44 and defining the end of one length of fence. After the guillotine cutters 63 have been actuated and moved downwardly to cut the stringer wires 44, the cutters are returned to their upward, or open, position, and the fence composed of the pickets 21 continues to flow through the opening in the guillotine frame 60, until another length of fence has been measured by the passage of the end bar 23 upon the belt 15, thereby again actuating the guillotine cutters 63.

The fence sections thus produced may be thus rolled or packaged in any other way for shipment from the location.

The present invention may be embodied in other specific forms without departing from the spirit or essential attributes thereof, and it is therefore desired that the present embodiment be considered in all respects as illustrative and not restrictive, reference being made to the appended claims rather than the foregoing description to indicate the scope of invention.

I claim:

1. A machine for automatically making elongate flexible sections of fence from a multiplicity of precut pickets and a flexible stringer along a horizontal work table, comprising:

a. an elongate endless moving belt for moving the pickets along the work table in a spaced relationship, said belt further having a start point defining the end of a fence section;

b. a hopper disposed vertically overlying the moving belt receiving and storing the multiplicity of pickets, and individually dispensing the pickets along the moving belt; the hopper further having a movable separator door and a settably mounted separator each attached forwardly onto the hopper bottom for separating the bottom two pickets from the stack and dropping said bottom-most picket onto said moving belt without interference of the second bottom picket thereabove;

c. means for drawing a continuous elongate stringer and positioning the stringer along the surface of the pickets along the moving belt;

d. means for positioning and affixing a fastener attaching the stringer at a defined location on each of said pickets; and e. a cutter assembly for cutting the stringer at predetermined lengths responsive to the position of the moving belt.

2. The apparatus according to claim 1 wherein the endless moving belt further comprises a plurality of elongate bars, each bar disposed transverse the length of said belt, in a spaced relationship therealong.

3. The apparatus of claim 2 wherein the start point comprises one of the plurality of bars having an extended width along the length of said belt longer than said remaining bars.

4. The apparatus of claim 1 wherein the picket separator door is bifurcated, having a settable plate, movably attached to said hopper, and having the separator door pivotally attached to said settable plate, the door further being biased to a position coplanar with said settable plate.

5. The apparatus according to claim 1 wherein the picket separator extends from the forward of the hopper downwardly and inwardly into said hopper terminating above said separator door.

6. The apparatus according to claim 4, wherein the picket separator is angularly disposed with respect to said picket separator door and extends inwardly into said hopper, terminating at a point more distant the belt than said separator door.

7. The apparatus as defined in claim 6 wherein said separator door is spaced from the peripheral surface of said belt a distance slightly greater than the height of one picket and said separator is spaced from the surface of said belt a distance slightly greater than the height of one and a half pickets.

8. The apparatus of claim 1 wherein the flexible stringer comprises an elongate sheet of a plastic material.

9. The apparatus of claim 1 wherein the flexible stringer comprises an elongate stringer wire.

10. The apparatus according to claim 1 wherein the means for positioning and affixing a fastener comprises;

a. at least one stringer wire guide;

b. a stapler located proximate to said wire guide for inserting staples, affixing said stringer wire to said picket.

11. The apparatus according to claim 10, wherein a second elongate stringer wire is positioned and fastened parallel to the first stringer wire.

12. The apparatus according to claim 1 wherein the cutter assembly further comprises a descending blade guillotine for cutting said flexible stringer at a predetermined position responsive to the position of said start point.

13. The apparatus according to claim 1 wherein the means for positioning and affixing a fastener comprises a fastening station having at least one stringer guide cooperating with a respective stapler located proximate thereto, said stringer guide disposed on a picket hold-down, the picket hold-down overlying said pickets upon said belt and being pivotally mounted at a first end; said stapler further being attached to a stapler mount, the stapler mount being pivotally mounted at a first end with the stapler attached proximate a second end of said stapler mount, the second end of the stapler mount further having a height adjustment means affixed thereon and overlying a second end of said picket hold-down; thereby said stapler, said stapler mount, and said picket hold-down cooperating to maintain said pickets abutting said belt and floating said stapler a settable height above said picket upper surface.

14. A machine for automatically making elongate flexible sections of fence from a multiplicity of precut pickets and a flexible continuous stringer along a horizontal work table, comprising:

a. an elongate endless moving belt for moving the pickets along the work table in a spaced relationship, said belt further having a start point defining the end of a fence section;

b. a hopper disposed vertically overlying the moving belt receiving and storing the multiplicity of pickets, and individually dispensing the pickets along the moving belt; the hopper further having a first separator comprised of a movable door biased closed and pivotally attached to the forward side of the bottom of the hopper for separating the bottom picket from the second bottom picket and dispensing said bottom-most picket onto said moving belt;

c. means for drawing the continuous stringer and positioning the stringer along the surface of the pickets along the moving belt;

d. means for positioning and affixing a fastener attaching the stringer at a defined location on each of said pickets; and e. a cutter assembly for cutting the stringer at predetermined lengths responsive to the position of the moving belt.

* * * * *

UNITED STATES PATENT AND TRADEMARK OFFICE

CERTIFICATE OF CORRECTION

PATENT NO. : 4,949,892

DATED : August 21, 1990

INVENTOR(S) : John C. Neely and John M. Czech, Jr.

It is certified that error appears in the above-identified patent and that said Letters Patent is hereby corrected as shown below:

Column 4, line 43, delete "$1\frac{1}{8}$" and replace it with --$\frac{1}{8}$--.

Signed and Sealed this

Seventh Day of January, 1992

*Attest:*

HARRY F. MANBECK, JR.

*Attesting Officer*

*Commissioner of Patents and Trademarks*